US009334079B2

(12) United States Patent
Lindstrom et al.

(10) Patent No.: US 9,334,079 B2
(45) Date of Patent: May 10, 2016

(54) LOGISTICS CRATE MODULE AND METHOD OF TRANSPORTING GOODS

(71) Applicant: K. Hartwall Oy Ab, Söderkulla (FI)

(72) Inventors: Johan Lindstrom, Söderkulla (FI); Juha Kosonen, Söderkulla (FI); Herrick Ramberg, Söderkulla (FI)

(73) Assignee: K. Hartwall Oy Ab, Soderkulla (FI)

( * ) Notice: Subject to any disclaimer, the term of this patent is extended or adjusted under 35 U.S.C. 154(b) by 63 days.

(21) Appl. No.: 14/228,128

(22) Filed: Mar. 27, 2014

(65) Prior Publication Data

US 2014/0291196 A1 Oct. 2, 2014

(30) Foreign Application Priority Data

Mar. 28, 2013 (EP) ..... 13161587

(51) Int. Cl.

| | |
|---|---|
| ***B65D 6/16*** | (2006.01) |
| ***B65D 19/12*** | (2006.01) |
| ***B65D 1/34*** | (2006.01) |
| *B65D 21/06* | (2006.01) |
| *B65D 1/22* | (2006.01) |

(Continued)

(52) U.S. Cl.

CPC ..... *B65D 1/34* (2013.01); *B65D 11/1833* (2013.01); *B65D 1/225* (2013.01); *B65D 11/186* (2013.01); *B65D 21/062* (2013.01); *B65D 25/005* (2013.01)

(58) Field of Classification Search

USPC ..... 220/7, 666, 1.5, 23.6, 4.28, 4.29, 4.34, 220/354, 605, 618, 621, 810, 508, 509, 512, 220/503, 821; 206/769, 508, 503, 499, 504, 206/509, 774, 766, 600; 108/53.1, 53.5, 108/56.1; 211/188, 189, 126.1, 126.2, 211/126.6, 132.1, 194, 195

See application file for complete search history.

(56) References Cited

U.S. PATENT DOCUMENTS 3,762,593 A * 10/1973 Beretta ..... 220/6
3,997,055 A * 12/1976 Box ..... 206/427

(Continued)

FOREIGN PATENT DOCUMENTS

GB 2471202 A 12/2010
WO 2011048259 A1 4/2011

OTHER PUBLICATIONS

European Search Report, dated Aug. 22, 2013, European Patent App. No. 13161587, K. Hartwall Oy Ab,2 pgs.

*Primary Examiner* — J. Gregory Pickett
*Assistant Examiner* — Gideon Weinerth
(74) *Attorney, Agent, or Firm* — Chernoff, Vilhauer, McClung & Stenzel, LLP

(57) ABSTRACT

A crate module which includes a quadrilateral tray portion with a load carrying side and an opposing side. The tray portion is delimited by four successively connected peripheral edges and has form fitting elements. The crate module also includes four side panels each of which have a proximal end, from which the side panel is pivotably connected to a respective peripheral edge, and a distal end having a counterpart form fitting element which is configured to cooperate with a corresponding form fitting element of the tray portion of a similar logistics crate in a superposed configuration. At least one of the side panels is pivotably connected to the respective peripheral edge on said opposing side of the tray portion.

11 Claims, 7 Drawing Sheets

(51) Int. Cl.
*B65D 6/18* (2006.01)
*B65D 25/00* (2006.01)

(56) References Cited

U.S. PATENT DOCUMENTS 4,300,695 A * 11/1981 Hsu ..... 220/6
4,491,231 A * 1/1985 Heggeland et al. ..... 220/6
4,674,647 A * 6/1987 Gyenge et al. ..... 220/6
4,760,921 A 8/1988 Licari
5,156,288 A * 10/1992 Levy ..... 220/4.29
5,538,153 A * 7/1996 Marovskis et al. ..... 220/6
5,797,508 A * 8/1998 Loftus et al. ..... 220/6
6,015,056 A * 1/2000 Overholt et al. ..... 220/6
6,131,757 A * 10/2000 Clark et al. ..... 220/7
6,446,825 B1 * 9/2002 Godoy ..... 220/6
6,966,449 B2 * 11/2005 Williams ..... 220/4.31
7,063,223 B2 * 6/2006 Iwahara et al. ..... 220/6
7,159,730 B2 * 1/2007 Rumpel ..... 220/7
7,438,197 B2 * 10/2008 Yamauchi ..... 220/7
7,478,734 B2 * 1/2009 Vargas ..... 220/4.34
7,549,255 B2 * 6/2009 Kirkwood ..... 52/69
2002/0179601 A1 * 12/2002 Haruhiro ..... 220/6
2003/0136781 A1 * 7/2003 Rumpel ..... B65D 11/1833 220/6
2003/0155275 A1 * 8/2003 Apps et al. ..... 206/600
2003/0173322 A1 * 9/2003 Rushing ..... 211/181.1
2004/0256385 A1 * 12/2004 Hartwall ..... 220/6
2007/0012640 A1 * 1/2007 Scholen ..... A47F 5/13 211/195
2007/0175847 A1 * 8/2007 Prest ..... A47F 5/137 211/195
2009/0057191 A1 * 3/2009 Temple et al. ..... 206/600
2009/0134057 A1 * 5/2009 Hidalgo Vargas .. B65D 11/1833 206/600
2009/0134156 A1 * 5/2009 Hadar ..... 220/4.28
2010/0181310 A1 * 7/2010 Haddad et al. ..... 220/4.29
2014/0174976 A1 * 6/2014 Ramberg et al. ..... 206/511

* cited by examiner

LOGISTICS CRATE MODULE AND METHOD OF TRANSPORTING GOODS

CROSS-REFERENCE TO RELATED APPLICATIONS

This application claims priority under 35 U.S.C. §119 to European Patent Application No. 13161587.4, filed Mar. 28, 2013.

BACKGROUND

The present invention relates to logistics equipment. In particular, the invention relates to logistics crates.

The tools used in present-day logistics of consumer products include cell trays, prismatic crates of different sorts, dollies, pallets, and such. Cell trays are mostly suited for transporting products, which can withstand external vertical loads so that products, such as beverage bottles, are loaded onto the trays, which can be then stacked on top of each other. Cell trays are a very advantageous way of transporting sturdy containers, since they take up very little space and enable handling by forklift. Certain consumer product packages, however, are not designed to withstand external vertical loads but rather to act as a protective shell to the contents. There is indeed a trend in the packaging industry to minimize packaging material not only for economic reasons but environmental impacts as well. This development affects the load carriers used in transporting such non-self supporting goods as cell trays, for example, cannot be used. Instead, such products are packed and transported in various kinds of crates that can be used in forming stacks. The crates are typically collapsible or they have a rigid frame. The rigid frame crates usually have a bottom piece, to which is fixed four opposing side walls that have handles of some sort. More popular are crates with four foldable walls, wherein the four walls are foldable for collapsing the crate so that the crate takes up minimal space during return logistics.

However, known foldable crates for non-self-supporting packages feature considerable disadvantages. Known collapsible crates have been found rather labor intensive and lacking display value as the goods have to be unloaded from the stack of crates and shelved. Traditional crates are therefore less user friendly because the goods need to be removed from the crate before they can be set up for sale into exhibiting trays, for example.

It is therefore an aim of the present invention to provide a way of transporting non-self supporting goods to the place of commerce with minimal staff involvement in setting the goods up for display. It is a particular aim to establish a crate which could be directly used for displaying the goods to the customer.

SUMMARY

The aim of the present invention is achieved with aid of a novel logistics crate module for forming a logistics crate. The crate module includes a quadrilateral tray portion with a load carrying side and an opposing side. The tray portion is delimited by four successively connected peripheral edges and has form fitting elements. The crate module also includes four side panels each of which have a proximal end, from which the side panel is pivotably connected to a respective peripheral edge, and a distal end having a counterpart form fitting element which is configured to cooperate with a corresponding form fitting element of the tray portion of a similar logistics crate in a superposed configuration. At least one of the side panels is pivotably connected to the respective peripheral edge on said opposing side of the tray portion. Thus at least one respective form fitting element of the tray portion is provided to the load carrying side such that at least one lateral side of a resulting logistics crate is formed by another such-like logistics crate module superposed on the logistics crate module.

The aim is on the other hand achieved with aid of a novel method of transporting non-self supporting goods in a logistics crate. In the method goods are loaded onto the load carrying side of a tray portion of a first logistics crate module which comprises at least one side panel which is hinged to a side which opposes the load carrying side of the tray portion. Another such-like second crate module is superposed on said first crate module such that said at least one side wall of said super-posed second crate module closes that lateral side of said first crate module which has said at least one side wall hinged to the side which opposes the load carrying side, thus forming the logistics crate.

Considerable benefits are gained with aid of the present invention. By virtue of the at least one downward extending side panel or wall that at least one side of the crate module is left exposed, wherein the customer is able to access the goods directly from the crate or stack thereof provided that the topmost module making up the topmost crate has been removed. As there are four side panels in each resulting crate, the stability of a stack of crates is secured.

The novel concept of having the load carrying side on top of pivoting side panels enables a completely new way of exhibiting goods in a place of commerce as the goods arrive to said place in a stack of crates which are directly ready for sale without the involvement of logistics or sale personnel. One possibility of exploiting the novel concept would be to transport goods to the place of commerce in a stack of crate modules on dollies which are then grouped with their closed sides facing each other for forming an island having exposed crate sides on its outer perimeter.

According to one embodiment two adjacent side panels extend downward, whereby two sides of the crate module are left open thus providing two selling directions. Said embodiment has the further advantage that such crate module is easy both stack and remove from a stack because the crate module may be tilted during lifting or lowering motion for negotiating the module in tight spaces.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE SEVERAL VIEWS OF THE DRAWINGS

In the following, exemplary embodiments of the invention are described in greater detail with reference to the accompanying drawings in which.

DETAILED DESCRIPTION

Figure 1:
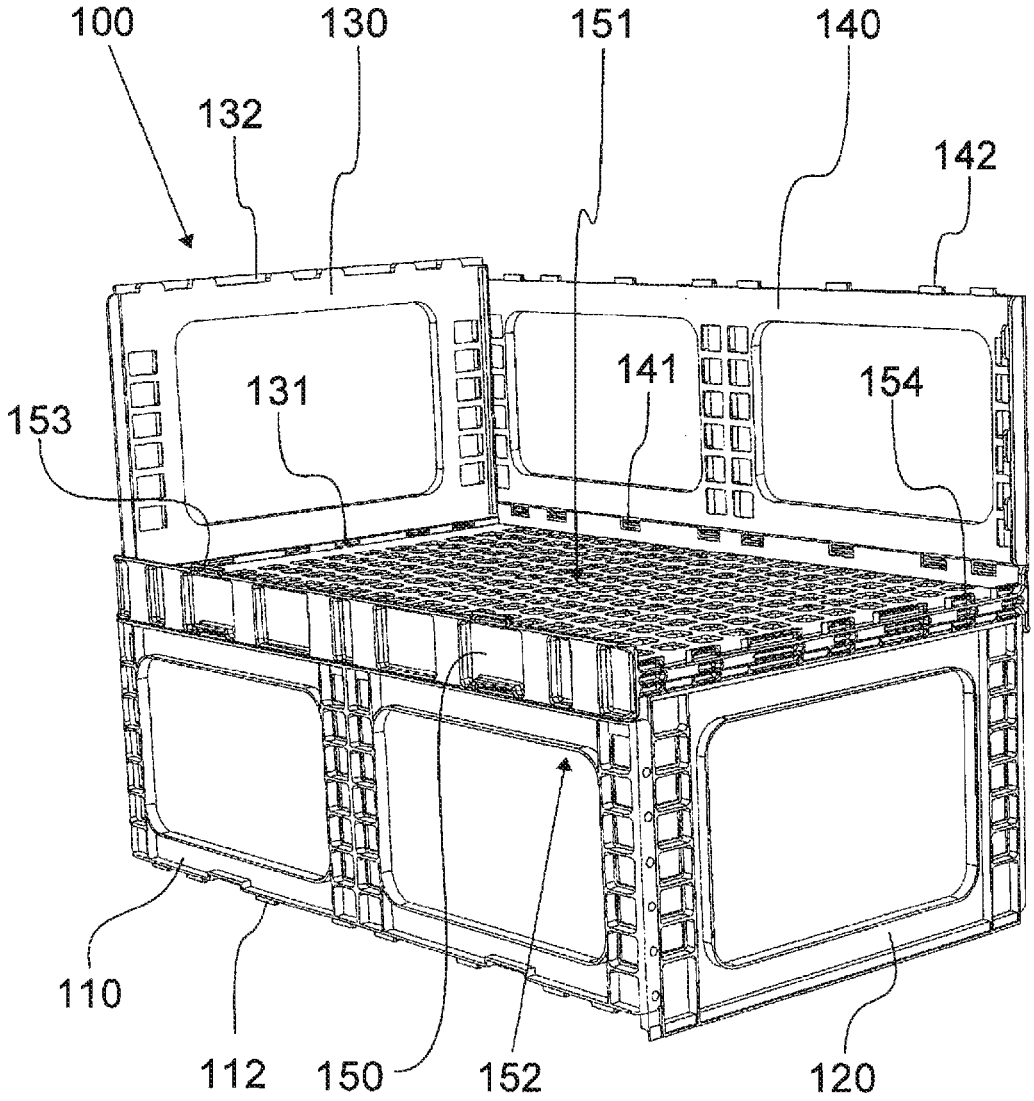
FIG. 1 presents an isometric view of a crate module according to one embodiment having two upwardly extending side walls and two downwardly extending side walls in a deployed configuration.

Turning first to FIGS. 1 to 5 which show a crate module according to one embodiment. As can be seen from the figures, the crate module 100 includes a tray portion 150 which has a load carrying side 151 and an opposing side 152, which in FIG. 1 are the top and bottom sides, respectively. The load carrying side 151 has a load carrying surface which is intended for receiving and supporting the contents 200 of the crate module 100. In the illustrated example, that load carrying surface is flat and provided with openings for lightening the structure and for acting as draining points. The opposing side has a similar under surface. The tray portion 150 is delimited by four successively connected peripheral edges. As best seen from FIGS. 4 and 5, the tray portion 150 has two opposing peripheral edges 157, 158 which are flanged for elevating hinge points for side panels from the load carrying surface and or from the under surface. The other two opposing sides, which are the short sides in the figures, are flush with the load carrying surface and with the under surface.

The crate module 100 has four side panels 110, 120, 130, 140. The first side panel 110 is pivotably connected to the flanged peripheral edge 157 on the opposing side 152 via hinge 111. More specifically, the first side panel 110 is hinged to the part of the peripheral edge 157 extending beyond the undersurface on the opposing side 152 which opposes the load carrying surface on the load carrying side 151. The hinge 111 is established by means of a pivotable snap-on fit between the proximal end of the first side panel 110. Adjacent to the first side panel 110 has been provided a second side panel 120 which has also been pivotably connected to a respective peripheral edge on the same opposing side 152 of the tray portion 150 via hinge 121.

On the load carrying side 151, the module 100 has a third and fourth side panel 130, 140 which are pivotably connected to respective adjacent peripheral edges on the load carrying side 151 of the tray portion 150. The third side panel 130 is connected to the edge opposing that for the second side panel 120 via hinge 131. The fourth side panel 140 is connected to the edge 158 opposing the connecting edge 157 for the first side panel 110, whereby the peripheral edge 158 for the fourth side panel 140 is flanged. In other words, the first and second side panels 110, 120 on the opposing side 152 are arranged on adjacent peripheral edges such that they are joined together in a corner of the quadrilateral tray portion 150, whereby the third and fourth side panels 130, 140 on the load carrying side 151 are arranged on adjacent peripheral edges such that they are joined together in a corner that diagonally opposes the corner joining the first and second side panels 110, 120 on the opposing side 151.

Figure 2:
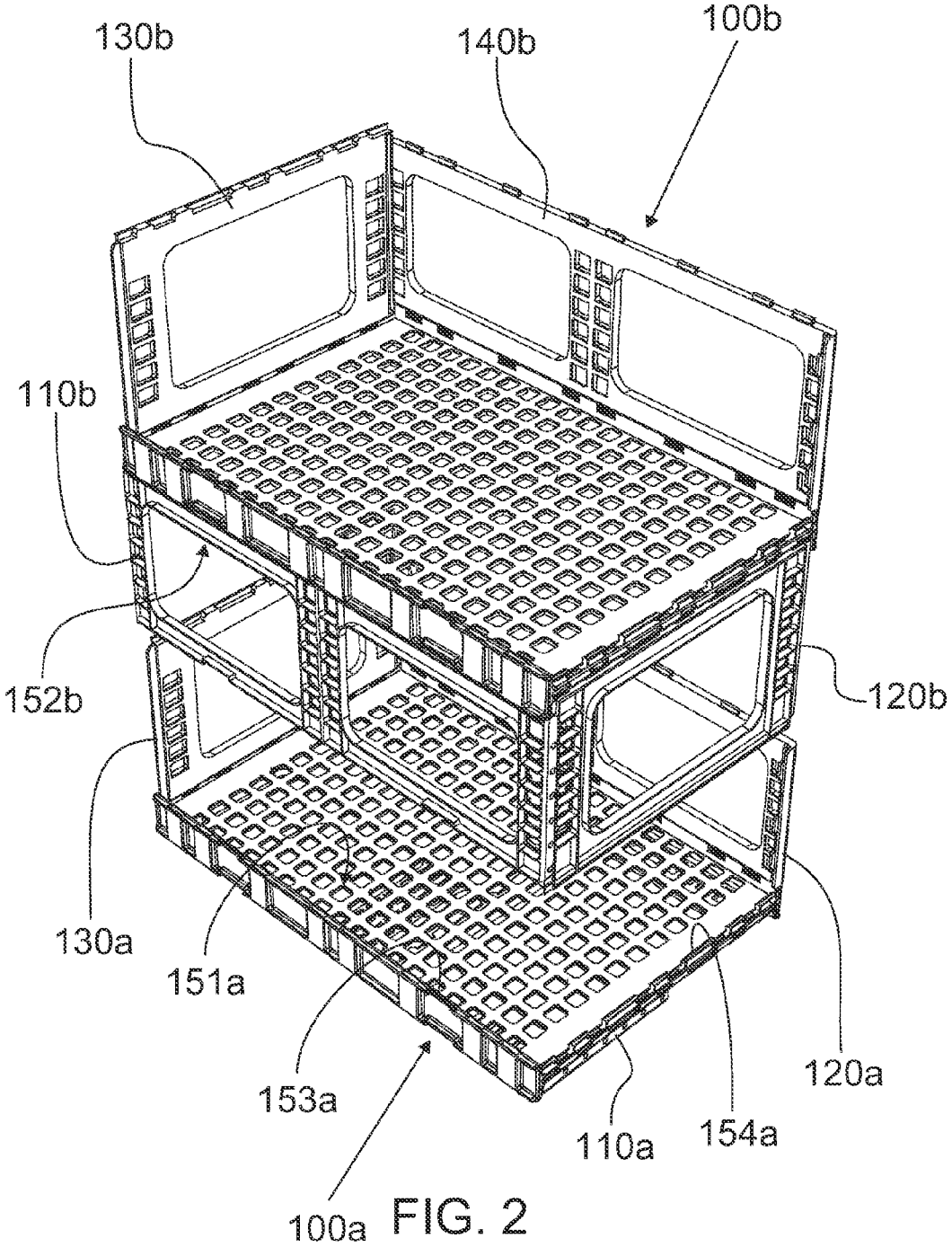
FIG. 2 presents an isometric explosion view of two crate modules of FIG. 1 in an inverted opposing position being distanced from another.
Figure 3:
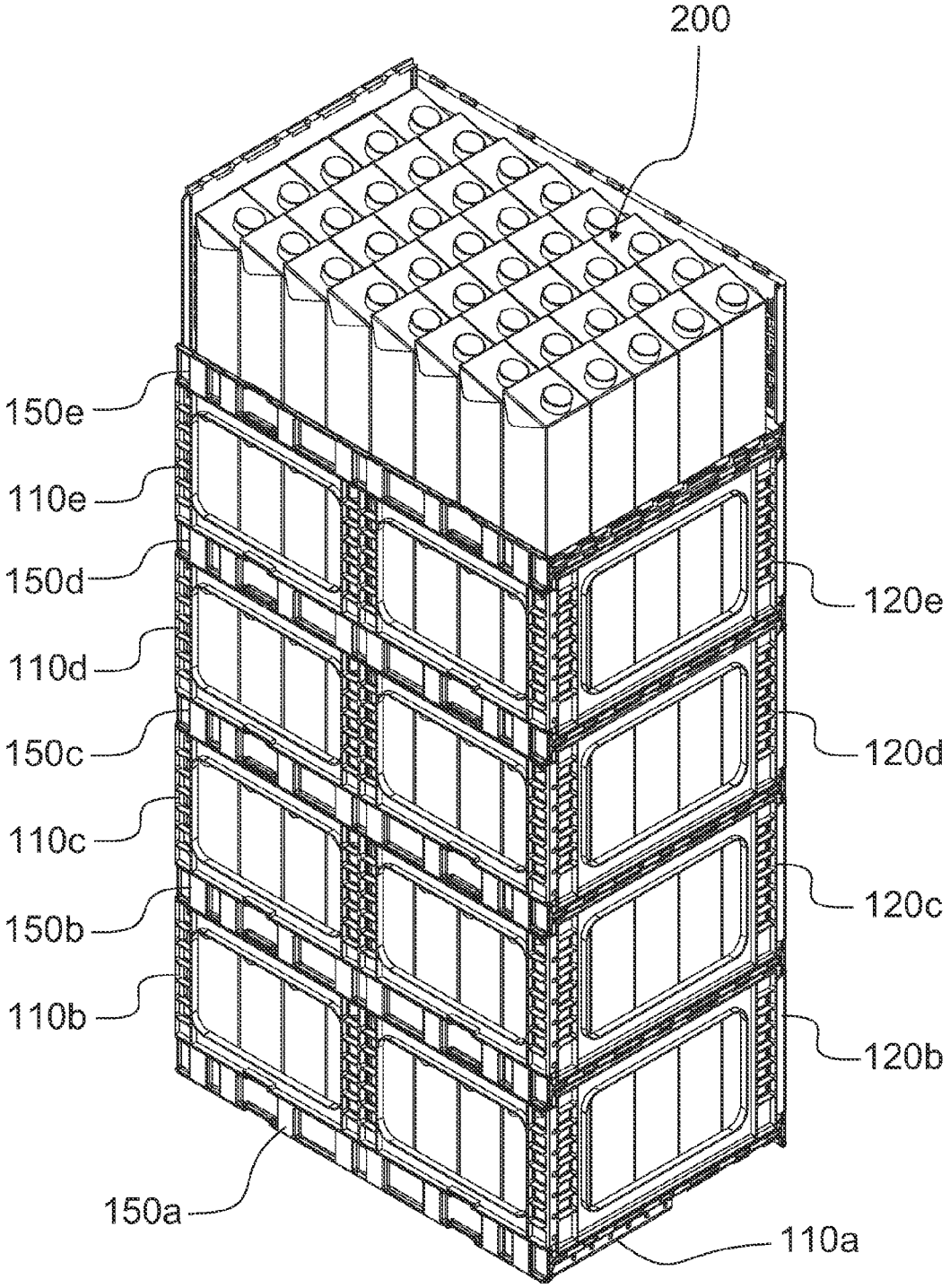
FIG. 3 presents an isometric view of a stack of crate modules of FIG. 2.
Figure 4:
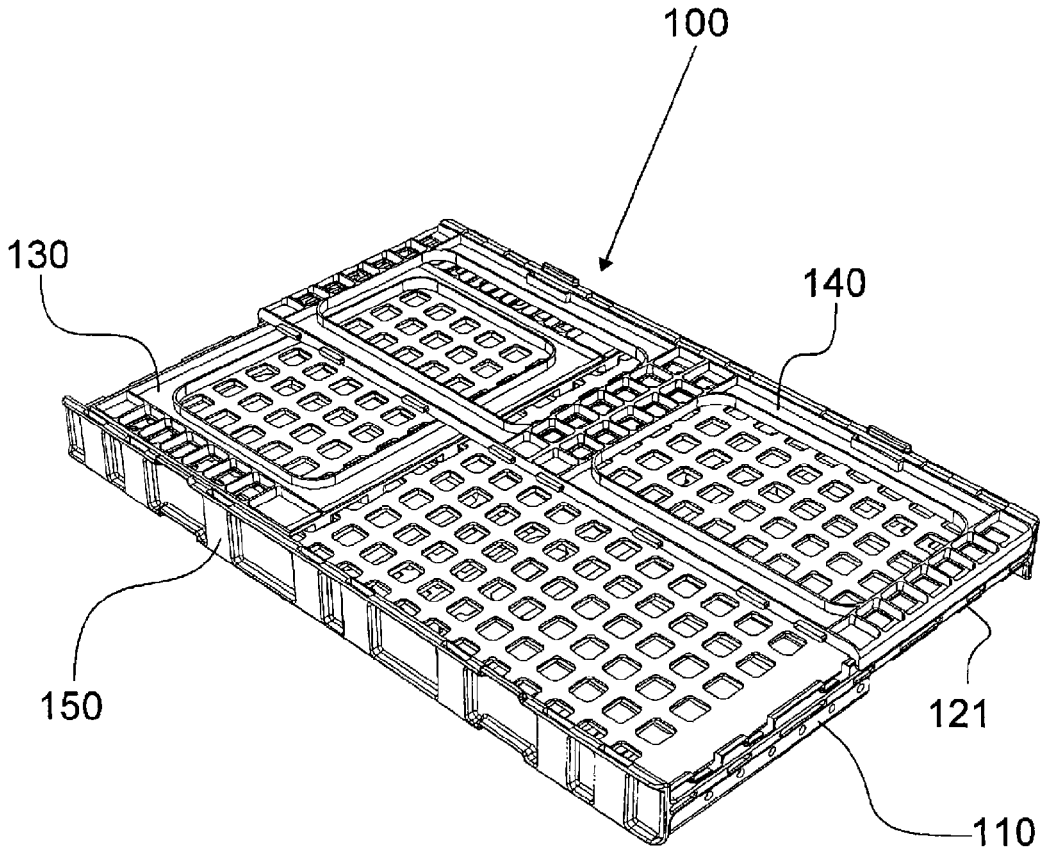
FIG. 4 presents an isometric view of the crate module of FIG. 1 in a folded configuration.
Figure 5:
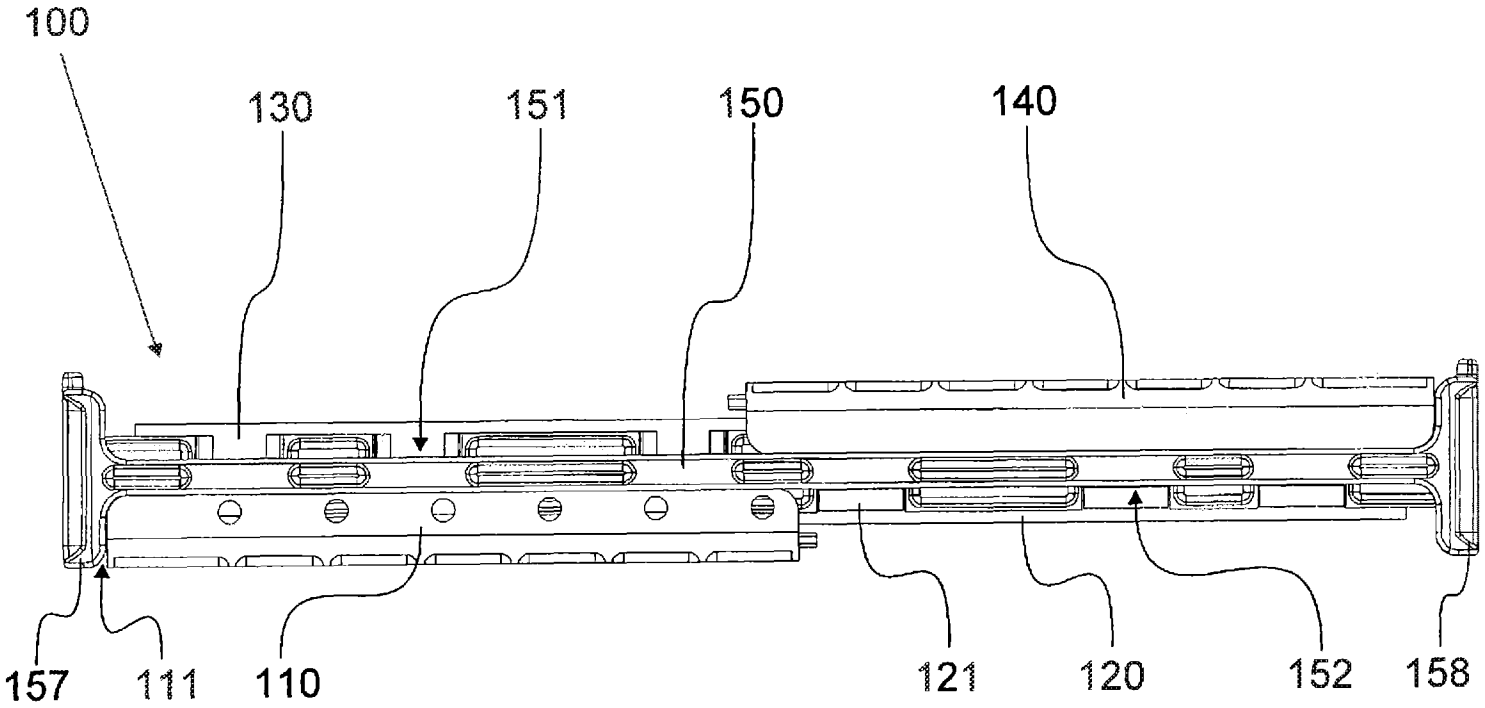
FIG. 5 presents a side view of the crate module of FIG. 4.

All four side panels 110, 120, 130, 140 on both sides 151, 152 of the tray portion 150 may therefore be pivoted between deployed and folded configurations. In the deployed configuration, the side panels 110, 120, 130, 140 extend orthogonally from the tray portion 150 as shown in FIGS. 1 to 3. In the folded configuration, the side panels 110, 120, 130, 140 are parallel to the tray portion 150. It is naturally possible to have some side panels in the folded configuration, such as the first side panel 110*a* of the lower crate module 100*a* of FIG. 2, and the others in the employed configuration. The flanged peripheral edges 157, 158 enable the adjacent side panels 110, 120, 130, 140 to be folded on top of each other in the folded configuration by elevating the hinge point of the superposing side panel 110, 140. In the illustrated example, however, the first and second side panels 110, 120 are configured to be parallel to the under surface of the opposing side 152 of the tray portion 150, when pivoted into the folded configuration, whereas the third and fourth side panels 130, 140 are configured to be parallel to the load carrying surface of the load carrying side 151 of the tray portion 150, when pivoted into the folded configuration.

While the proximal ends of side panels 110, 120, 130, 140 feature hinges 111, 121, 131, 141, the distal ends of the panels have form fitting elements 112, 132, 142. The tray portion 150 includes cooperating form fitting elements 153, 154 which are provided to the load carrying side 151, and more specifically to the peripheral edges on the load carrying side 151 of the tray portion 150. The form fitting elements 112, 132, 142 of the side panels are configured to cooperate with the corresponding form fitting elements 153, 154 of the tray portion 150 of a similar logistics crate in a superposed configuration as illustrated by FIG. 2. In the shown example, the female form fitting elements (not visible in the drawing) at the distal ends of the first and second side panel 110*b*, 120*b* of the superposed crate module 100*b* are configured to lock onto the male form fitting elements 153*a*, 154*a* on the corresponding peripheral edges on the load carrying side 151*a* of the receiving crate module 100*a*. Once the two crate modules 100*a*, 100*b* have been joined, a crate is formed.

For improved rigidity, the mating side edges of the first and second side panel 110, 120 as well as of the third and fourth side panel 130, 140 include cooperating form fitting elements for locking the mating side panels 110, 120, 130, 140 to the deployed configuration. The form fitting elements on the mating side edges are best shown in FIG. 1 as locking studs provided to the side edge of the first panel 110, where the studs engage with receptive openings in the second side panel 120. In operation, the side panels 110, 120, 130, 140 would be first locked into the deployed configuration with aid of the locking studs, after which the deployed modules would be locked into each other.

Turning now to FIG. 3 in greater detail, a fully loaded stack of five crate modules is shown. The stack is founded on a first crate module whose tray portion 150*a* carries the load of the stack. In the illustrated example the first crate module is not placed on the ground but it is instead placed on a dolly or similar wheeled device for easy handling. The first and second side panel 110*a* of the first module, having panels hinged to the opposing side of the tray portion thereof, are in a folded configuration, wherein the first and second side panel 110*a* are parallel to the opposing side 152. The third and fourth side panel (not visible in FIG. 3) are erect, i.e. are in the deployed configuration. After the first crate module has been loaded with goods 200, a second such crate module is superposed on the first module. Unlike the first and second side panel 110*a*, 120*a* of the first module, the first and second side panel 110*b*, 120*b* of the second module are erect, i.e. in deployed configuration. The downward extending first and second side walls 110*b*, 120*b* of the second crate module close the respective sides of the first crate module. The form fitting elements at the distal ends of the first and second side walls 110*b*, 120*b* of the second crate module are secured to the cooperating form fitting elements on the peripheral edges of the tray portion 150*a* of the first crate module. Thus, the first crate is formed by the interlocked first and second crate module.

The tray portion 150*b* of the second crate module receives weight of the goods in the second layer from the bottom up. After being loaded, the second crate module is covered with a third crate module as described above, whereby a second crate is formed by the interlocked first and second crate module. Also similarly, the tray portion 150*c* of the third crate module receives the weight of the next level and so on. In the illustrated example the stack includes five crate modules which form four crates, whereby the goods 200 on the tray portion 150*e* of the fifth top crate module are exposed from above as well as from the long and short side. FIG. 3 shows the stack in exhibiting condition, wherein the goods 200 on the topmost crate module are accessible. During transport, however, the topmost module is covered with a sixth crate module (not shown). The sixth module is an extra module used to form the top most crate by engaging to the fifth tray portion 150*e* of the topmost crate module. The sixth module is configured such that the first and second side panels are in a deployed configuration and engage to the tray portion 150*e* of the topmost module. The third and fourth side panels of the sixth crate module are folded down.

As the goods 200 are transported according to the described method, the goods 200 in the top layer are readily accessible from three sides. As soon as the top layer is empty, the top crate module may be easily lifted on the fourth crate module. With aid of the novel side panel construction, the top crate module is easy to remove because during lifting, the first and second side panel 110*e*, 120*e* of the fifth crate module may be tilted up, whereby the stack may be torn down even in tight spaces. The empty top crate module may be folded into the folded configuration for space saving purposes in return logistics, for example.

Figure 6:
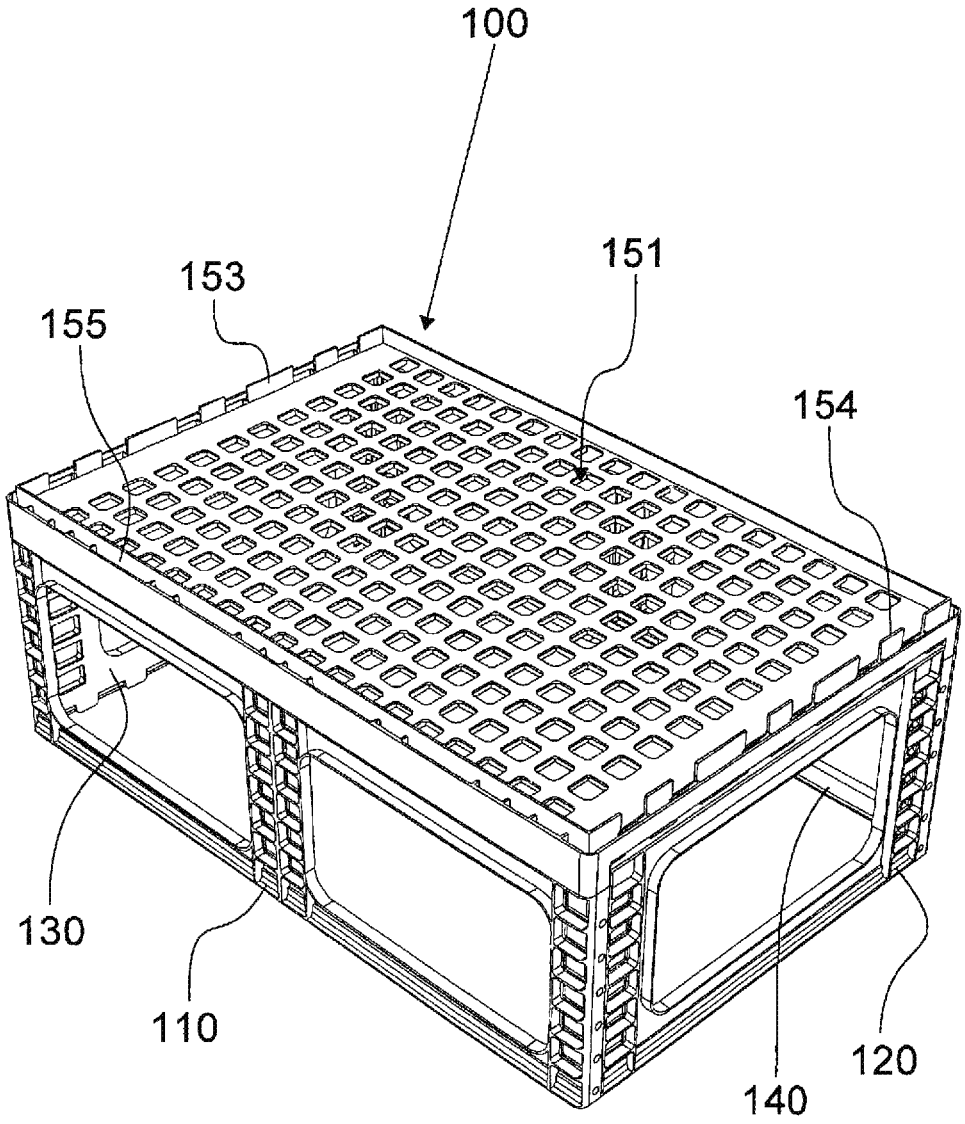
FIG. 6 presents an isometric view of a crate module according to another embodiment having four downwardly extending side walls in a deployed configuration.
Figure 7:
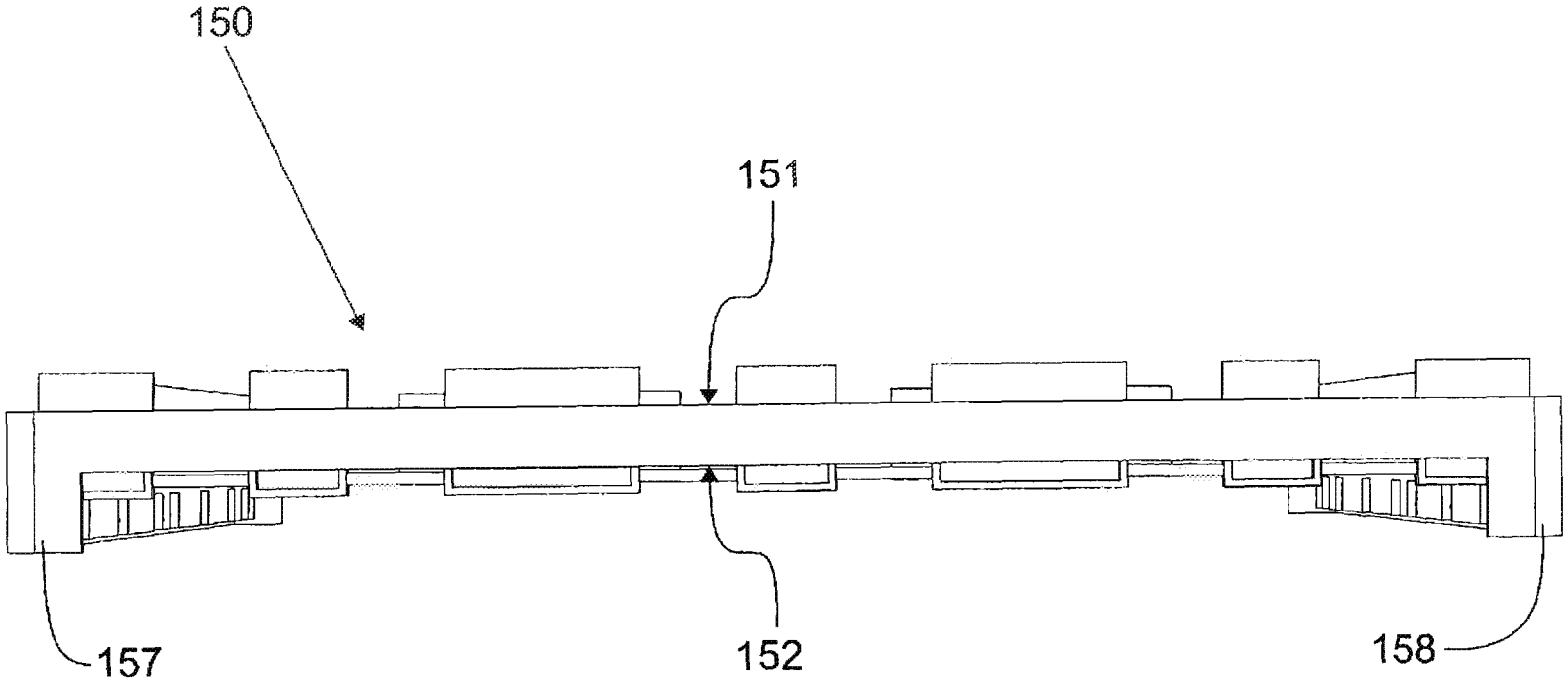
FIG. 7 presents a side perspective view of the tray portion of the crate module of FIG. 6 without side panels.

Turning now to FIGS. 6 and 7 which illustrate a second embodiment, the crate module may include four side panels 110, 120, 130, 140 which are all pivotably connected to respective peripheral edges on the opposing side 152 of the tray portion 150. The four side panels 110, 120, 130, 140 are all configured to be parallel to the load carrying surface of the load carrying side 151 of the tray portion 150, when pivoted into the folded configuration (not shown). Such a folding configuration is possible by virtue of the flanged tray portion as shown in FIG. 7. The opposing peripheral edges, which in the illustrated example are the longer sides, extend past the undersurface of the opposing side 152 which opposes the load carrying side 151. As in the embodiment of FIGS. 1 to 5, the load carrying side 151 includes the load carrying surface, which is intended to make contact with and support the goods loaded onto the module. In the folded configuration the opposing short side panels—i.e. the second and third side panel 120, 130—are first folded down, wherein their distal ends are adjacent while the side panels 120, 130 are parallel to the opposing side 152. Next, the longer side panels—i.e. the first and fourth side panel 110, 140—are folded down, wherein their distal ends are adjacent while the side panels 110, 140 are also parallel to the opposing side 152 but due to the elevated hinge points by the flanged edges 157, 158, the first and fourth side panel 110, 140 are folded on top of the second and third side panel 120, 130.

Otherwise, the crate module according to the second embodiment may be used similarly to that of the first embodiment. The crate module forming the lowest layer of a stack is first manipulated into the folding configuration, wherein all four downward extending side panels 110, 120, 130, 140 are folded into the horizontal folding configuration. After the first crate module has been loaded, a second crate module in an deployed configuration is superposed onto the first one, wherein all four downward side panels of the second crate module engage with cooperating form fitting elements 153, 154, 155 on the load carrying side 151 of the first crate module. Thus, the first crate is formed by the interacting first and second mutually superposed crate modules. Subsequent layers are formed similarly, until the top layer will exhibit goods which are loaded onto the load carrying surface of the tray portion 150 of the topmost crate module, wherein the goods are accessible from all four sides as well as from above.

While there have been shown and described fundamental novel features of the invention as applied to a preferred embodiment thereof, it will be understood that various omissions and substitutions and changes in the form and details of the method and device may be made by those skilled in the art without departing from the spirit of the invention. For example, it is expressly intended that all combinations of those elements which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

We claim:

1. A logistics crate module comprising:

a tray portion and side panels;

the tray portion bounded by four peripheral edges and having a load carrying side and an opposing side, where the tray portion comprises at least one first form fitting element on the load carrying side;

the side panels each having a proximal end pivotably connected to a respective peripheral edge of the tray portion and a distal end comprising at least one second form fitting element capable of cooperatively engaging with a first form fitting element, thereby allowing a stacked configuration where a side panel of an upper logistics crate module can form a lateral wall for a lower logistics crate module.

2. The logistics crate module according to claim 1, wherein said side panels are pivotable between:

a deployed configuration wherein said panels extend orthogonally from the tray portion, and a folded configuration wherein said panels are parallel to the tray portion.

3. The logistics crate module according to claim 1, wherein:

the load carrying side comprises a load carrying surface configured to receive and support contents for the crate module, the opposing side comprises an under surface, and wherein the tray portion comprises two opposing peripheral edges, which are flanged for elevating hinge points for the side panels from the load carrying surface or from the under surface.

4. The logistics crate module according to claim 3, wherein a first side panel and a second side panel of the crate module are each pivotably connected to respective peripheral edges on said opposing side of the tray portion, and wherein a third side panel and a fourth side panel of the crate module are pivotably connected to respective peripheral edges on said load carrying side of the tray portion.

5. The logistics crate module according to claim 4, wherein the first side panel and the second side panel are arranged on adjacent peripheral edges such that they are joined together in a corner of the tray portion, and wherein the third side panel and the fourth side panel are arranged on adjacent peripheral edges such that they are joined together in a corner of the tray portion, where the corner diagonally opposes that of the corner joining the first and second side panels.

6. The logistics crate module according to claim 4, wherein mating side edges of the first and second side panel as well as mating edges of the third and fourth side panel each comprise cooperating form fitting elements for locking the side panels in a deployed configuration.

7. The logistics crate module according to claim 4, wherein the first side panel and the second side panel are parallel to the under surface of the opposing side of the tray portion when pivoted into a folded configuration, and wherein the third side panel and the fourth side panel are parallel to the load carrying surface of the load carrying side of the tray portion when pivoted into a folded configuration.

8. The logistics crate module according to claim 1, wherein said side panels are each pivotably connected to respective peripheral edges on said opposing side of the tray portion such that said side panels are each configured to be parallel to the undersurface of the opposing side of the tray portion, when pivoted into a folded configuration.

9. A method of carrying or supporting goods using a plurality of logistics crate modules, each of said plurality having a tray portion with a load carrying side and a second side opposed to the load carrying side, and each of said plurality having a side panel hinged to the second side of the tray portion, the method comprising:

loading goods onto the load carrying side of a tray portion of a first logistics crate module; and positioning a second logistics crate module on top of said first logistics crate module such that the side panel of the second logistics crate module closes a lateral side of the first logistics crate module.

10. The method according to claim 9, wherein each of the plurality of crate modules comprises:

a tray portion and side panels;

the tray portion bounded by four peripheral edges and having a load carrying side and an opposing side, where the tray portion comprises at least one first form fitting element on the load carrying side;

the side panels each having a proximal end pivotably connected to a respective peripheral edge of the tray portion and a distal end comprising at least one second form fitting element capable of cooperatively engaging with a first form fitting element, thereby allowing a stacked configuration where a side panel of an upper logistics crate module forms can form a lateral wall for a lower logistics crate module.

11. The method according to claim 9, wherein the hinged side panel of the first logistics crate module is in a folded configuration parallel to the opposing side of the tray portion.

* * * * *